US006020868A

United States Patent [19]

Greene et al.

[11] Patent Number: 6,020,868

[45] **Date of Patent: *Feb. 1, 2000**

[54] COLOR-MATCHING DATA ARCHITECTURES FOR TILED, FLAT-PANEL DISPLAYS

[75] Inventors: Raymond G. Greene, Ovid; Robert H. Katyl, Vestal; J. Peter Krusius, Ithaca, all of N.Y.; Robert Sechler, Austin, Tex.; Boris Yost, Ithaca, N.Y.

[73] Assignee: Rainbow Displays, Inc., Endicott, N.Y.

[ * ] Notice: This patent is subject to a terminal disclaimer.

[21] Appl. No.: 08/780,911

[22] Filed: Jan. 9, 1997

[51] Int. Cl.[7] ..... G09G 3/36

[52] U.S. Cl. ..... 345/88; 345/199; 345/903; 348/383

[58] Field of Search ..... 345/1, 88, 103, 345/199, 903; 348/383

[56] References Cited

U.S. PATENT DOCUMENTS

| | | | |
|---|---|---|---|
| 4,727,425 | 2/1988 | Mayne et al. | 358/523 |
| 4,799,053 | 1/1989 | Van Aken et al. | 345/199 |
| 5,341,153 | 8/1994 | Benzshawel et al. | 345/88 |
| 5,359,342 | 10/1994 | Nakai et al. | 345/89 |
| 5,396,257 | 3/1995 | Someya et al. | 345/1 |
| 5,539,431 | 7/1996 | Nishioka et al. | 345/199 |
| 5,652,605 | 7/1997 | Nishioka et al. | 345/199 |
| 5,668,569 | 9/1997 | Greene et al. | 345/103 |
| 5,696,539 | 12/1997 | Welti et al. | 345/1 |
| 5,838,396 | 11/1998 | Shiota et al. | 348/383 |

*Primary Examiner*—Mark R. Powell
*Assistant Examiner*—Vincent E. Kovalick
*Attorney, Agent, or Firm*—Salzman & Levy

[57] ABSTRACT

The present invention features a tiled, flat-panel display (FPD) that has color-matching between the tiles, which is accomplished by a direct transformation of video data through values stored in tables, and addressed by the spatial position in both the display and the input data value. One or more transformation tables are disposed proximate a graphics controller, which synchronizes, routes and controls the timing of data to data (column) drivers of the FPD. The transformation tables may be read-only or read-write memory devices. They are used to provide data representative of corrections or adjustments of color luminance on a pixel-by-pixel, or sub-pixel-by-sub-pixel basis, thus matching color of all portions of a display tile and all tiles in the FPD. This invention also describes a method of determining the values for the tables by measuring the common luminance response of the regions of the display.

10 Claims, 15 Drawing Sheets

COLOR-MATCHING DATA ARCHITECTURES FOR TILED, FLAT-PANEL DISPLAYS

FIELD OF THE INVENTION

The present invention pertains to tiled, flat-panel, matrix-addressed, electronic displays and, more particularly, to architectures, data structures and electronic circuitry, all of which are useful for producing color characteristics in such displays, resulting in a visual appearance that is equivalent to monolithic displays.

BACKGROUND OF THE INVENTION

With modern microfabrication-based manufacturing techniques, mass production of matrix-addressed, electronic flat-panel displays (FPDs) has become routine. Alternative forms of such displays are currently based on a number of different technologies, including liquid crystal (active-matrix, or AMLCD, and passive-matrix, or STN), plasma, field emission and thin CRT, as well as electroluminescence (EL). A flat, rectangular viewing area is generally provided, as are two sets of orthogonal electrical lines, one for data, and the other for control.

Few attempts have been made, heretofore, to fabricate large-sized FPDs. One approach has been to construct the generally large viewing area by using an array of smaller, discrete FPDs, or tiles. Some of the construction techniques for these large displays are discussed hereinafter.

The color image on an electronic display is produced by an aggregate of individual picture elements, called pixels, that comprise the viewing area of the display. Each pixel has additional internal structure, usually three, discrete, sub-pixels that generate the primary colors, with the usual choices being red, green and blue. It is convenient to assume that the color coordinates of each primary-color type of sub-pixel (e.g., green) do not vary so much as to be objectionable to the average viewer over the area of a single tile (intra-tile) or between tiles (inter-tile). Where this condition is not met, methods for correcting tiled FPDs are described in co-pending patent applications bearing Ser. Nos. 618,046 (filed Mar. 25, 1996); 628,308 (filed Apr. 5, 1996); 636,604 (filed Apr. 23, 1996), and 649,240 (filed May 14, 1996), all of which are hereby incorporated by reference.

Each sub-pixel is further characterized by a monotonic input-signal versus luminance relationship. An electrical characteristic of the input signal (such as DC level, rms or peak-to-peak AC level, frequency, pulse width, etc.) sent to each sub-pixel is varied to produce a desired amount of light corresponding to the sub-pixel's color (e.g., red luminance) in order to create that part of the image represented by that primary color at that pixel. A typical, tiled FPD might have 640 columns of pixels by 480 rows of pixels, or, 307,200 red, green and blue sub-pixels.

The ultimate objective in producing a high-quality, color representation of the target image on a display is is the same, or within the color and brightness discrimination limits, for all sub-pixels of the same color across the entire display. This is not normally achieved in mass-produced displays for consumer products such as television sets and computer monitors.

Viewers of television sets and computer monitors (in both CRT and liquid-crystal displays) usually accept gradual luminance variations on the order of 20 percent between one region of the display and a remote region (center-to-corner, e.g.). This is acceptable to the average viewer, because the human eye does not perceive small gradual changes in luminance or chromaticity as objectionable. Display devices and systems that meet this condition are said to obey a "low-gradient" rule.

Large changes in luminance or chromaticity between one region of the display (having any large number of contiguous pixels) and another region where the change occurs across a narrow, distinct boundary region (e.g., one or a few pixels wide) are not acceptable to the average viewer. Under ideal viewing conditions, abrupt changes of one percent or less can be objectionable; under less-than-ideal conditions, the objectionable threshold could be much higher, perhaps as large as ten percent. Display devices and display systems that have this objectionable condition are said to have "high gradient". The criteria of both human visual perception and display quality (especially with respect to luminance and chromaticity gradients) for tiled FPDs are described in more detail in the aforementioned co-pending patent applications.

Because of the nature of manufacturing processes, in conjunction with market forces, consumer display systems usually meet the low-gradient rule. However, it is quite possible, and even likely, that individual FPD devices, panels or tiles meeting the low-gradient rule will, when assembled to make a larger, tiled display, exhibit the high-gradient condition. The methods, designs, processes, manufacturing and set-up procedures to produce such a display are known as "tiling". The high-gradient condition is most likely to occur across the boundary, or, the seams between the tiles. An even more egregious condition may occur at corners where four tiles meet. At such a so-called saddle point, a positive luminance gradient with respect to the corner point may exist in one direction therethrough, and a negative luminance gradient with respect to said corner point along another line distinct from the first one.

Since a tiled FPD made from panels that meet the low-gradient rule is likely to exhibit the unacceptable, high-gradient condition, a new and unique set of problems must be solved to make tiled displays visually acceptable. Novel inventions are required for tiling, if the resultant display is to meet the low-gradient rule.

Color matching is any technique used to produce a tiled FPD that meets the low-gradient rule, via individual tiles or other display system components or subsystems (e.g., a backlight), which might contribute to a resultant, high-gradient condition without the application of such methods. Color matching is a necessary but not sufficient condition for producing a tiled display which has the equivalent visual appearance to the viewer of a monolithic display without any seams.

Color-matching methods may be classified into two broad categories, transformation of data and display set-up. In the aforementioned co-pending patent application, bearing Ser. No. 618,046, color-matching methods achieved by display set-up techniques are described. These include spatially varying the neutral density filter and using tile- and sub-tile-based set-up parameters (such as reference and cutoff voltages, for example). These techniques do not change or transform the input video data; rather, they change the display characteristics (such as gain, offset and optical density).

The aforementioned co-pending patent applications describe, variously, color-matching methods that are based on transforming data derived from smoothing algorithms, splines, coefficient tables, etc., or that are based on transforming data via photometric or calorimetric relations. These methods have in common at least some real-time computation to transform data, the storage of coefficients necessary to perform the data transformation, and algorithms and hardware to implement the methods.

SUMMARY OF THE INVENTION

In accordance with the present invention, there are provided methods of color matching, by storing, retrieving, and delivering into the tiled FPD display transformed values of input data, based on the value of the input data, and the spatial location of the destination of this data. Described herein are color-matching methods that directly transform data, based on mapping input data to transformed, output data values, without any real-time computation or the storage of coefficients. Rather, all of the transformed values for each region of a tiled display are stored and recalled as needed. This level of manipulation of transforming data to small groups of contiguous pixels, and even single sub-pixels, may be required to eliminate a high-gradient condition at the seams and tile corners of a display. One or more transformation tables are disposed proximate a graphics controller, which synchronizes, routes and controls the timing of data (usually column) drivers of the FPD. The transformation tables may be read-only or read-write memory devices. They are used to provide data representative of corrections or adjustments of color luminosity on a pixel-by-pixel, or sub-pixel-by-sub-pixel basis, thus matching color of all portions of a display tile and all tiles in the FPD. This invention also describes a method of determining the values for the tables by measuring the common luminance and chromaticity response of the regions of the display. Various architectures are described for performing this direct, look-up transformation of data with respect to the relevant, standard components of a tiled FPD system.

It is the object of this invention to provide a color-matched, tiled FPD.

It is another object of this invention to provide direct, transformation architectures using look-up data, both system and component, for tiled FPDs.

It is a further object of this invention to provide methods for finding appropriate transformed values for data based on the value of the input data and the spatial location of the destination of the display data.

BRIEF DESCRIPTION OF THE DRAWINGS

A complete understanding of the present invention may be obtained by reference to the accompanying drawings, when considered in conjunction with the subsequent, detailed description, in which.

DESCRIPTION OF THE PREFERRED EMBODIMENT

Prior to describing the color-matching data architectures and techniques of the present invention, it is useful to briefly describe matrix-addressed displays 10 and the relationships of their parameters.

Figure 1:
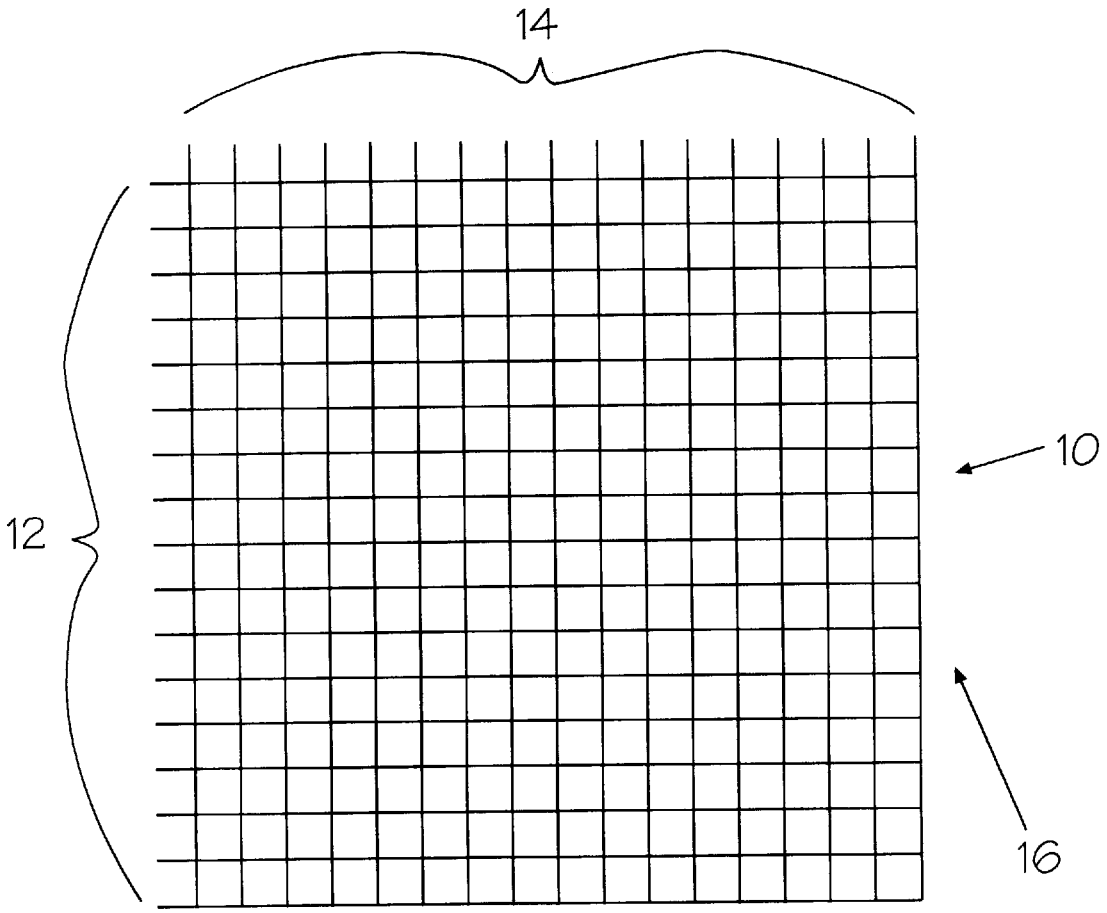
FIG. 1 is an electrical schematic of a matrix-addressed FPD, with electrical lines for control signals (shown horizontally) and electrical lines for data signals (shown vertically)

Now referring to FIG. 1, a flat, rectangular viewing area 16 is depicted in a block diagram, showing two sets of electrical lines, one for data 14 and the other for control 12.

Figure 2:
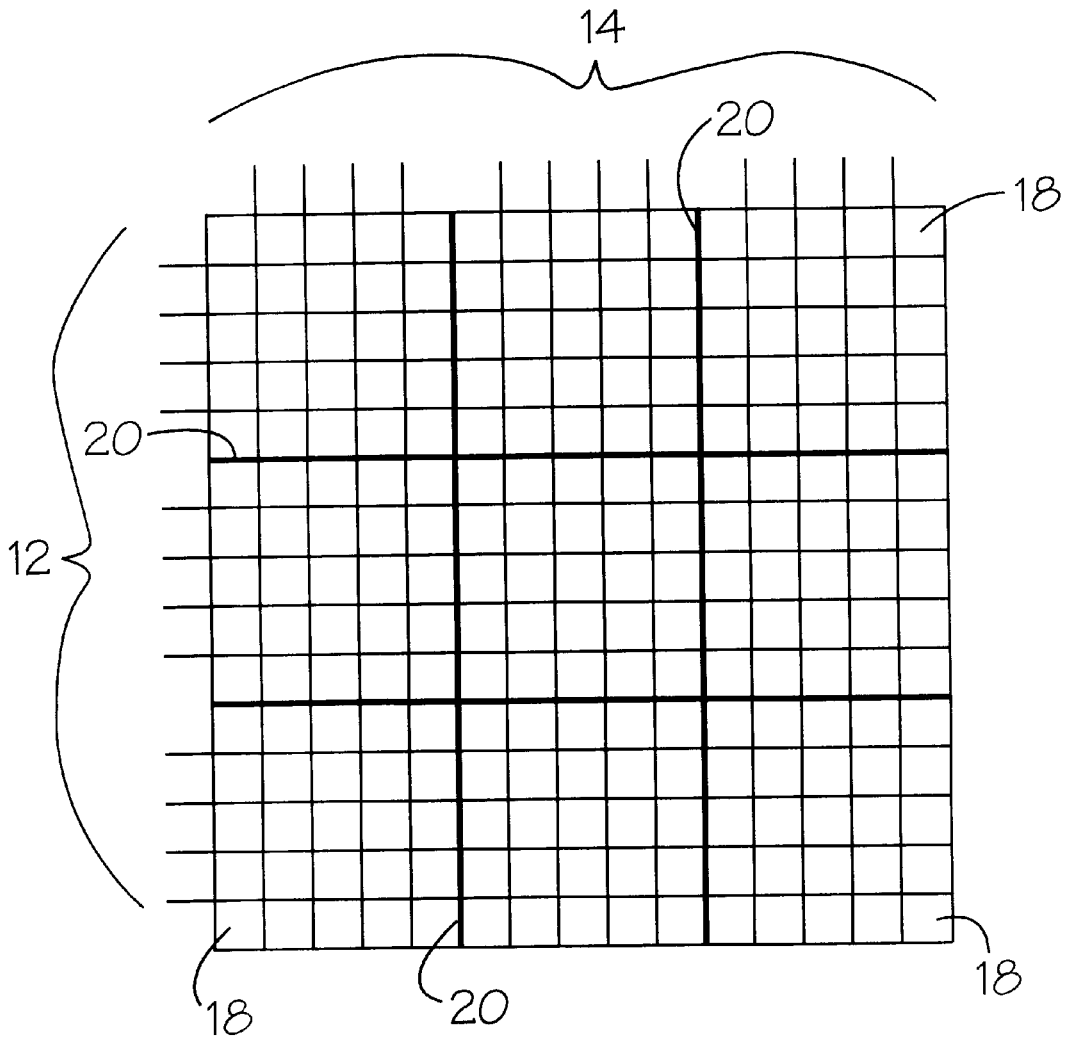
FIG. 2 is an electrical schematic of a 3×3 tiled, matrix-addressed FPD.

FIG. 2 is an illustrative, electrical schematic of a generic, tiled FPD with a 3×3 array of tiles. This display has essentially the same visual attributes as FIG. 1, except that its larger viewing area comprises smaller FPDs arranged into tiles 18. Seams 20 exist between any two adjacent tiles.

Figure 3:
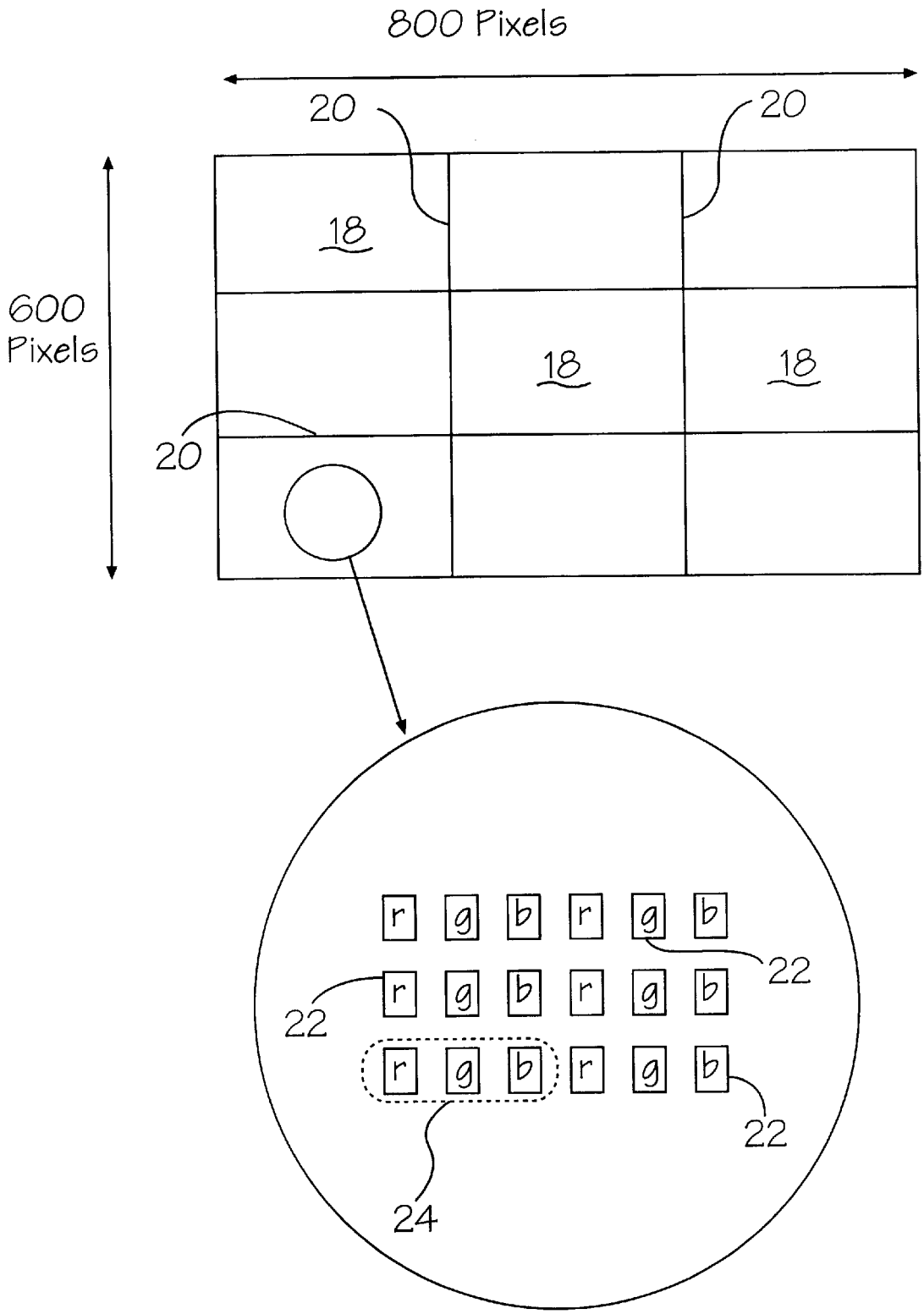
FIG. 3 is a schematic representation of the arrangement of pixels and sub-pixels in the viewing area of a typical, tiled FPD.

FIG. 3 illustrates arrangement of pixels 24 and sub-pixels 22 in the viewing area of a typical, tiled FPD.

Figure 4:
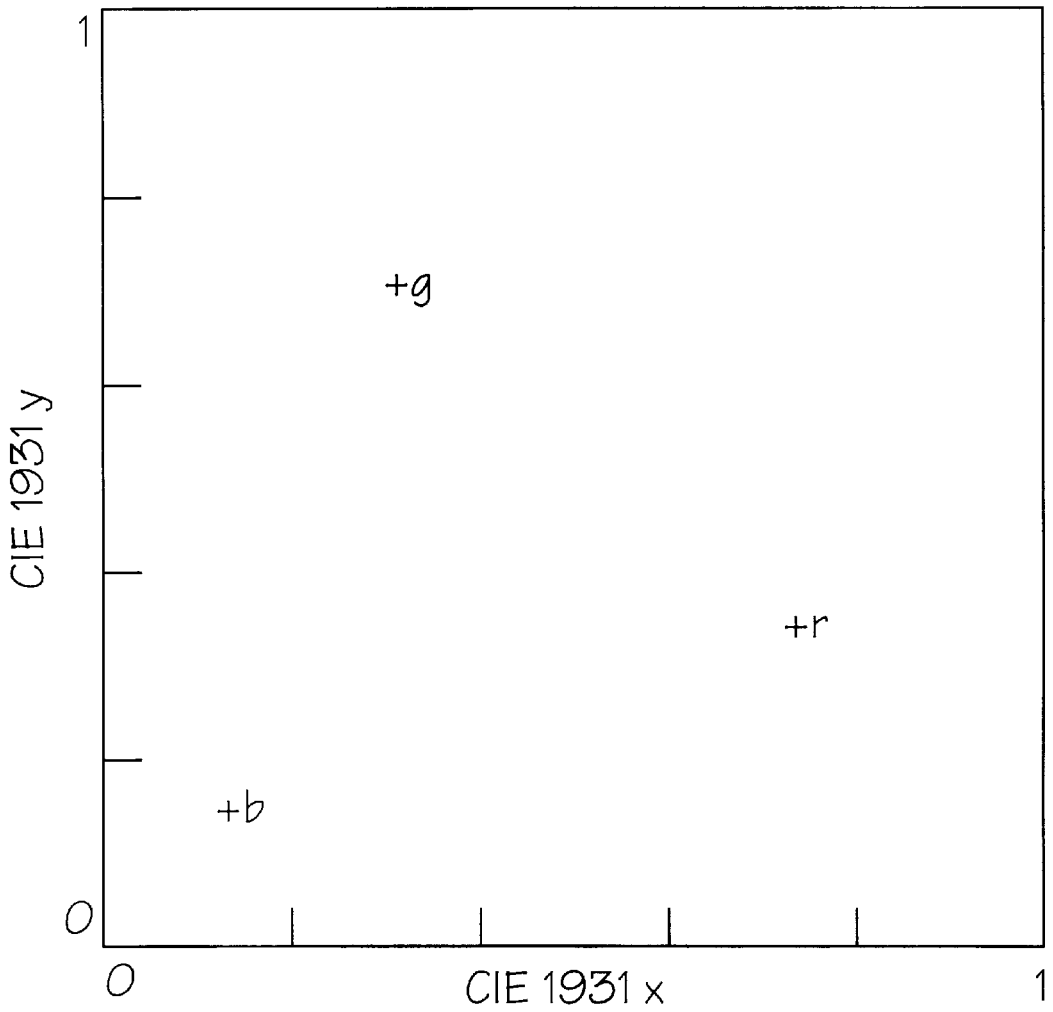
FIG. 4 is a graphical representation illustrating the CIE 1931 color coordinates (x,y) of primary colors on a typical, tiled FPD, "r", "g" and "b" denoting red, green and blue primary colors.

FIG. 4 shows color coordinates (x,y) of the primary colors on a typical, tiled FPD in the CIE 1931 representation 26. The set of priorities chosen for this illustration are defined by the 1953 NTSC phosphor chromaticities.

Figure 5:
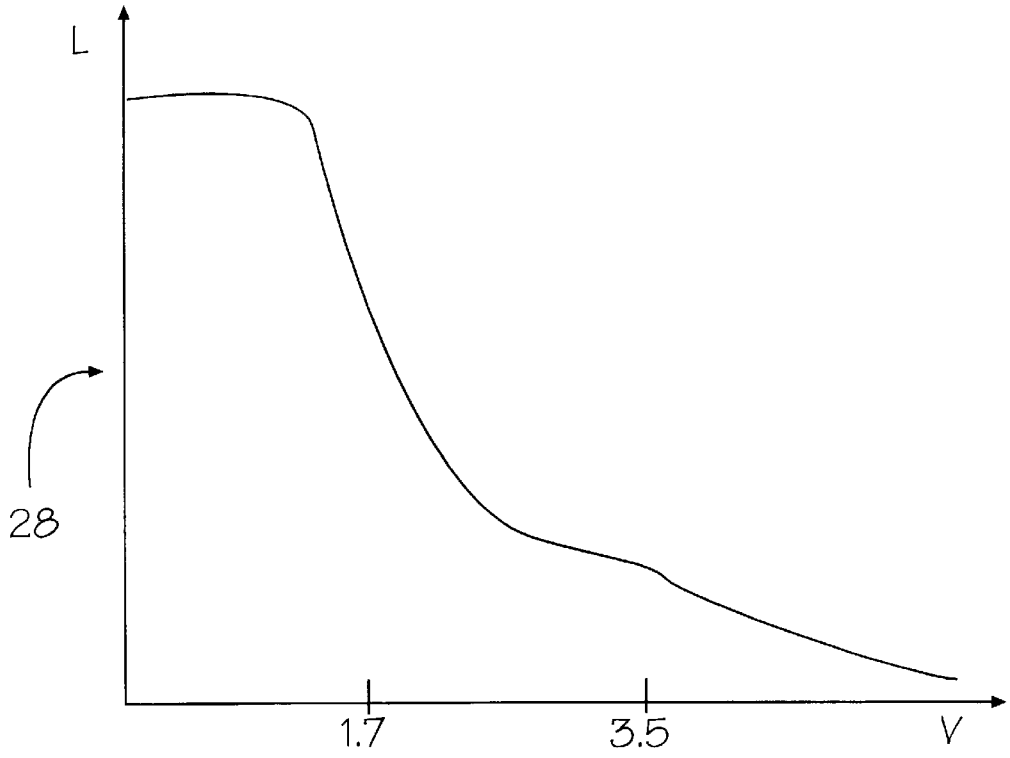
FIG. 5 is a graphical representation illustrating the relationship between the luminance "L" and drive voltage of a sub-pixel "V" for an AMLCD-type FPD.

FIG. 5 depicts a typical sub-pixel luminance, L, as a function of its drive voltage, V, in an active-matrix, liquid-crystal display (AMLCD).

Figure 6:
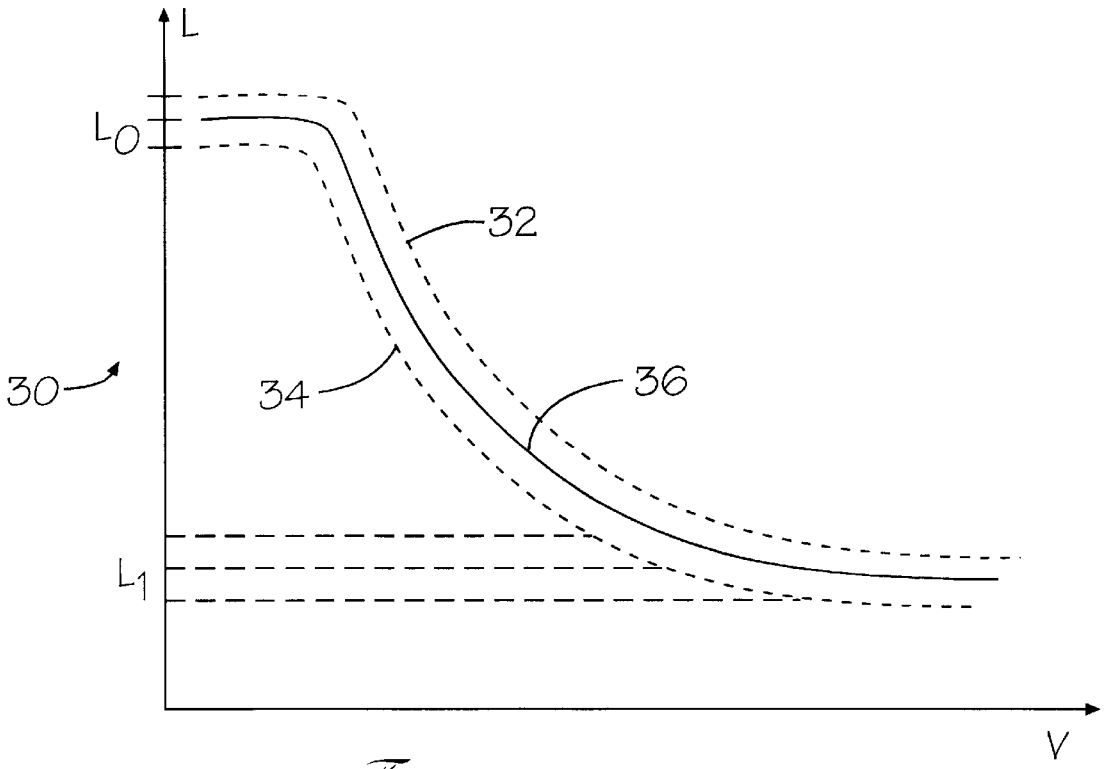
FIG. 6 is a graphical representation illustrating the ideal luminance-input signal relationship, where input signal variations lead to sub-pixel luminance responses that are within the visual perception threshold for each primary color of the entire, tiled FPD.

FIG. 6 portrays the ideal case for which the luminance response 30 for all values of input signals is the same for all sub-pixels of the same primary color over the entire display. The nominal response is given by the curve 36. Luminance variations higher and lower than the nominal are bounded by arrows 32 and 34, respectively. The vertical spacing of the curves is on the order of 1% for typical conditions.

Figure 7:
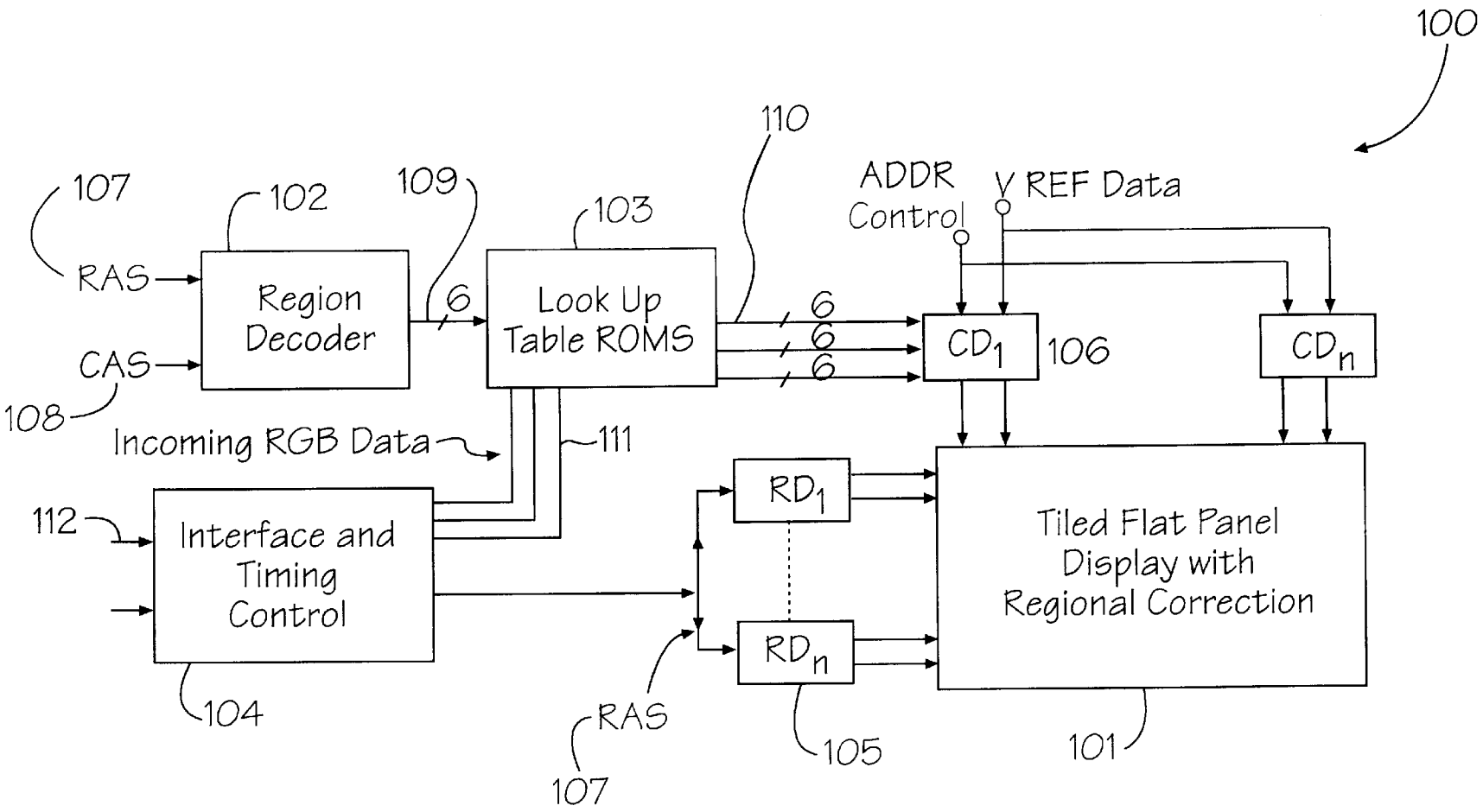
FIG. 7 is a functional block diagram of a tiled flat panel with video control and color matching functions.

Referring now to FIG. 7, an overall system view of the display electronic assembly 100 is shown, which uses the tabular data to produce a corrected image in real time. This assembly is based on random access memory (RAM) or read-only memory (ROM) chips, which store the correction data for the electronic display.

Data can be loaded into RAM chips, not shown, in the region decoder 102 and/or look-up table 103 when the electronics is initialized during system start-up; alternatively, this data can be factory loaded into ROM. Because the data is infrequently loaded, but read many times, for simplicity, the memory is hereinafter referred to as ROM memory. Data lines ill for writing data into the RAM chips are shown for clarity.

Sub-pixel control devices, thin film transistors (TFTs) for AMLCD's for example (not shown in FIG. 7) in the tiled, flat-panel display 101, are driven by row drivers 105 and column drivers 106. Corrected RGB data 110 are provided to the display columns of display 101, and then transferred to the sub-pixel control devices. For example, in an AMLCD the data will be placed onto the display sub-pixel storage capacitors (not shown in FIG. 7), by an impulse to the TFT gates on the display rows, driven by row driver electronics 105. This operation is performed under control of timing and synchronization pulses from the display and interface controller 104.

For clarity of the discussion of the invention, the display 101 is assumed to have the SVGA resolution with 800 columns and 600 rows of pixels. Extension to displays with other resolutions or color definitions will be obvious to any individual with an understanding of electronic displays. The number of gray scales for each SVGA primary color is $2^6$=64, encoded six binary digits. Thus, the data bus for each primary color is six bits wide, as applied to lines 110.

Figure 8:
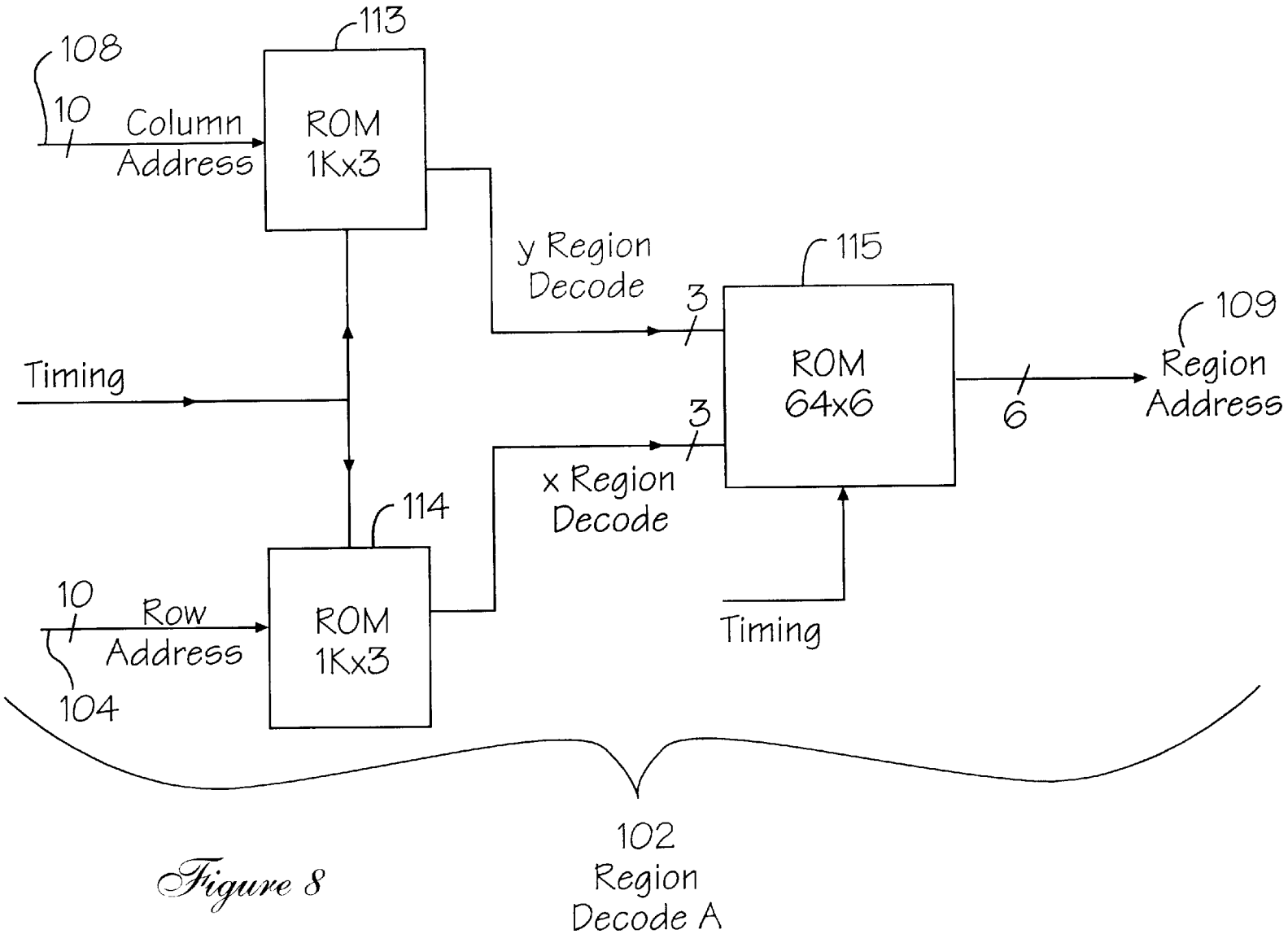
FIG. 8 is a block diagram of the internal structure of a pixel region decoder.
Figure 9:
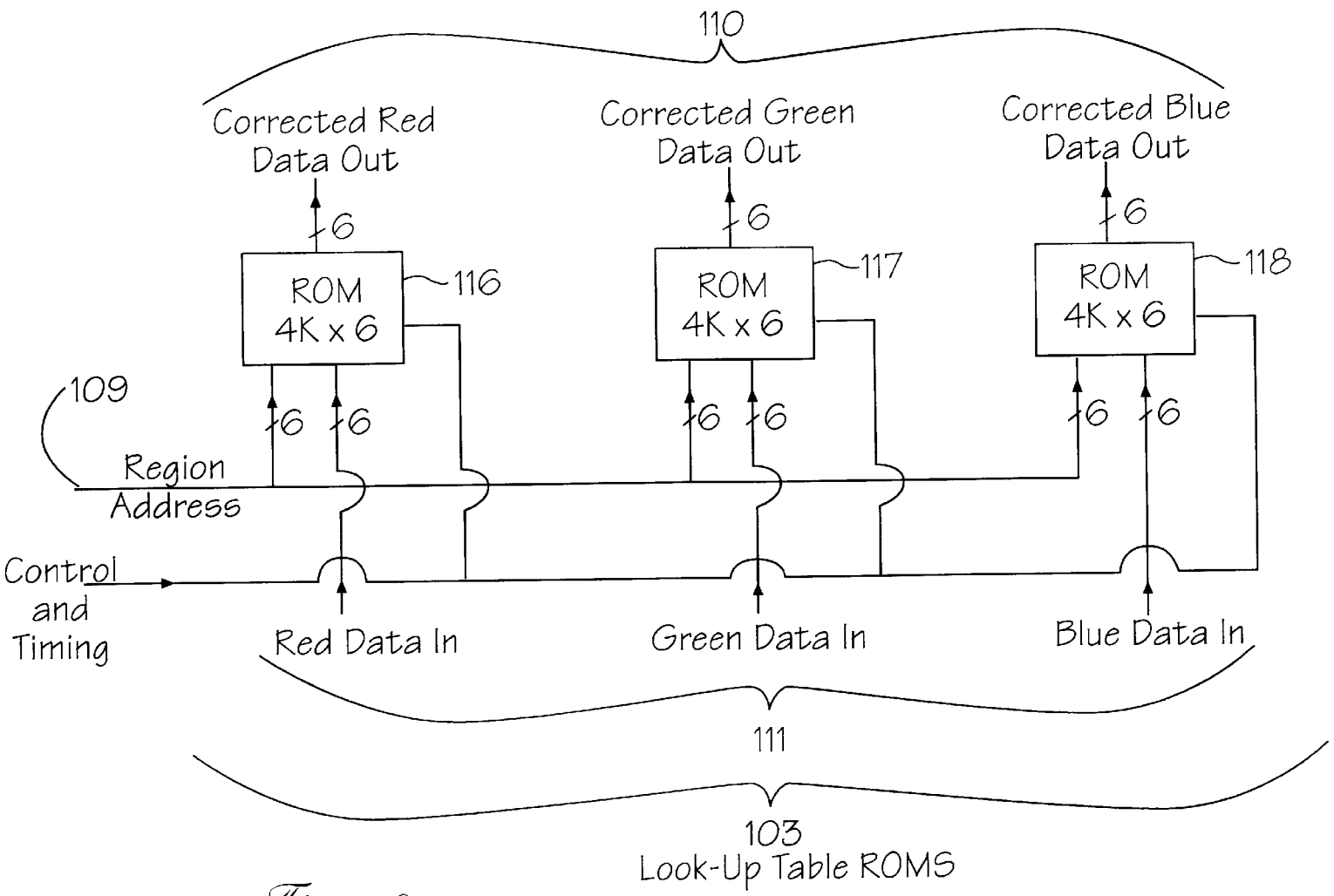
FIG. 9 is a block diagram of the internal structure of video data correction look-up tables.

Video data correction is performed in the look-up table 103, shown in greater detail in FIG. 9. Incoming RGB data 111 enters the look-up table 103 and is converted into new corrected data, applied to lines 110. The look-up table 103 obtains the proper region address for each pixel 109 from region decoder 102, shown in greater detail in FIG. 8. This region decoder converts row and column addresses 107 and 108, respectively, to serial region addresses for the pixels. The data in the region decoder 102 and the correction data in the look-up table 103 can be computed using procedures described later in this disclosure, and then stored in ROMs to be used in real time by the display assembly 100.

As mentioned above, a detailed view of the region decoder 102 is shown in FIG. 8. The 600 rows of an SVGA display are encoded in 10 column address lines 108 ($2^{10}$= 1024>800). To achieve the regional decoding, an entry is stored in the ROM 113 for the regional coordinate of each column of the display 101 (FIG. 7). A 1K×3 ROM can hold sufficient data for as many as eight regions along the x direction, distributed over up to 1024 columns. Similarly, a 1K×3 ROM 114 is sufficient for eight regions along the y direction, giving a maximum region count of 64. The x and y region indices are each encoded into three bits each. This total of six bits is used to access a 64×6 ROM 115 that contains the translation between the indices of regions x and y, and the region serial address 109.

As mentioned above, look-up table ROMs 103 are shown in greater detail in FIG. 9. Each of the three ROMS, 116, 117, 118, is 4K×6 in capacity and contains pre-computed corrections for each primary color for each region. The data are addressed by a 12-bit word. The low-order six bits carry the incoming video data, and the high-order six bits contain the region address. Appropriate control and timing synchronization signals are obtained from the display controller 104, not shown in this Figure. The corrected RGB data is then sent to the column drivers 106 (FIG. 7).

The above discussion is an illustration of a hardware implementation of the look-up correction tables, and the regionalization concept for the purity correction. The described circuitry could be placed onto a single application-specific integrated circuit (ASIC) or a set of programmable logic array (PLA) and RAM chips by using digital design techniques means well known within the electronics industry. Other signals that would be required, such as the data lines for initialization of the RAM circuitry are not shown, but their requirements should be obvious to those skilled in the art.

Figure 10:
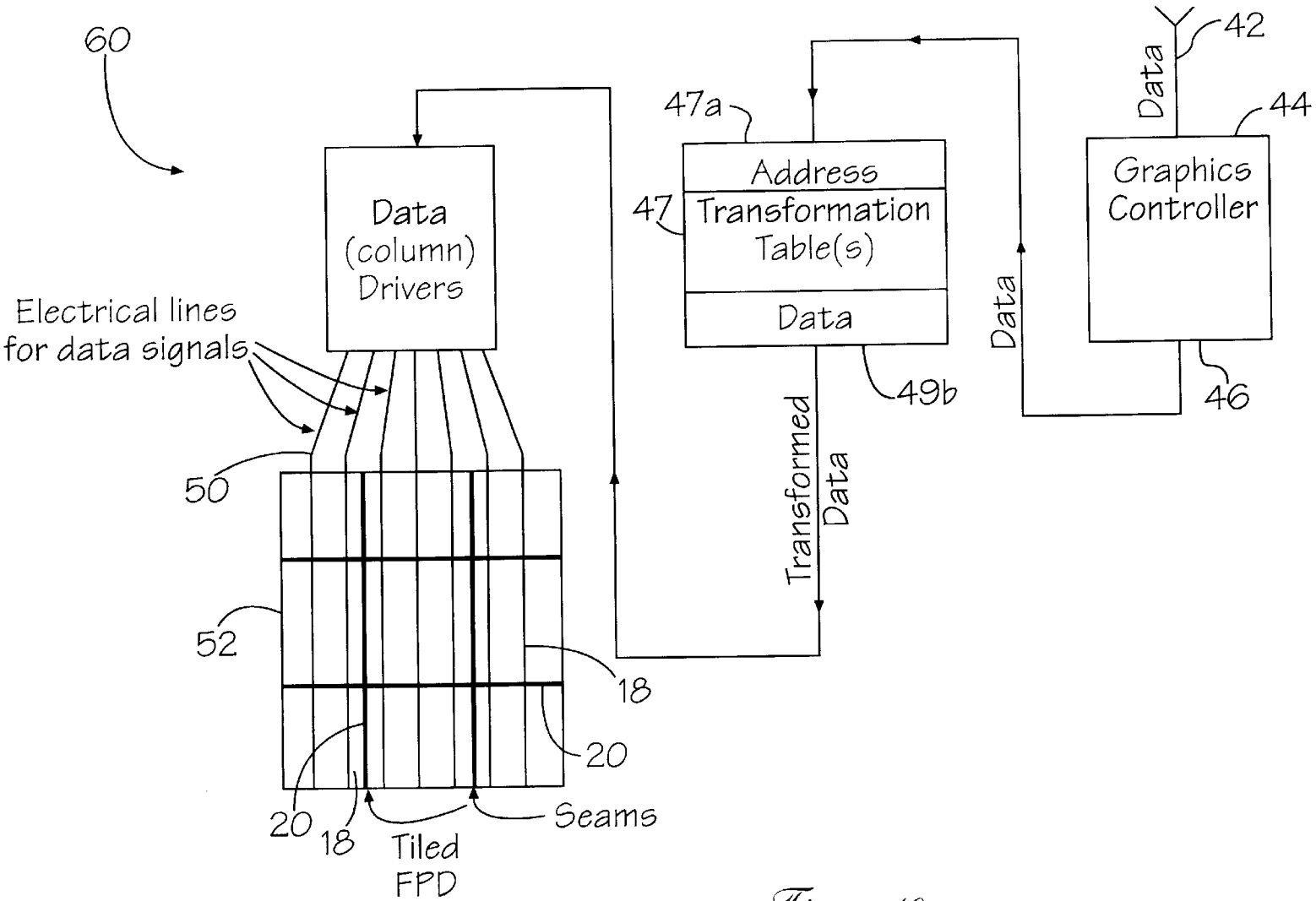
FIG. 10 is a block diagram representing the first general data path architecture for color matching by direct data transformation from a read-only table.

Referring now to FIG. 10, a high-level block diagram 60 of the tiled display is shown, representing a general, data-path architecture for color-matching a tiled FPD by direct transformation through a table. In addition to the components, graphics controller 44, data drivers 48, data lines 50 and pixel array 52 (shown and described in detail above), a transformation table 47 is disposed between the graphics controller 44 and the data drivers 48. This table 47 uses as address information both the spatial destination (from a sub-pixel to variously-sized, large groups of contiguous pixels) of the data in the tiled FPD and the values of the data itself. The value retrieved from this address 47*a* of the table 47 is then sent on to the data drivers 48, via the data portion 47*b* of the table 47, in the same manner as is done in a conventional display without any color matching. The transformation table 47 is functionally a read-only memory device in this embodiment.

Figure 11:
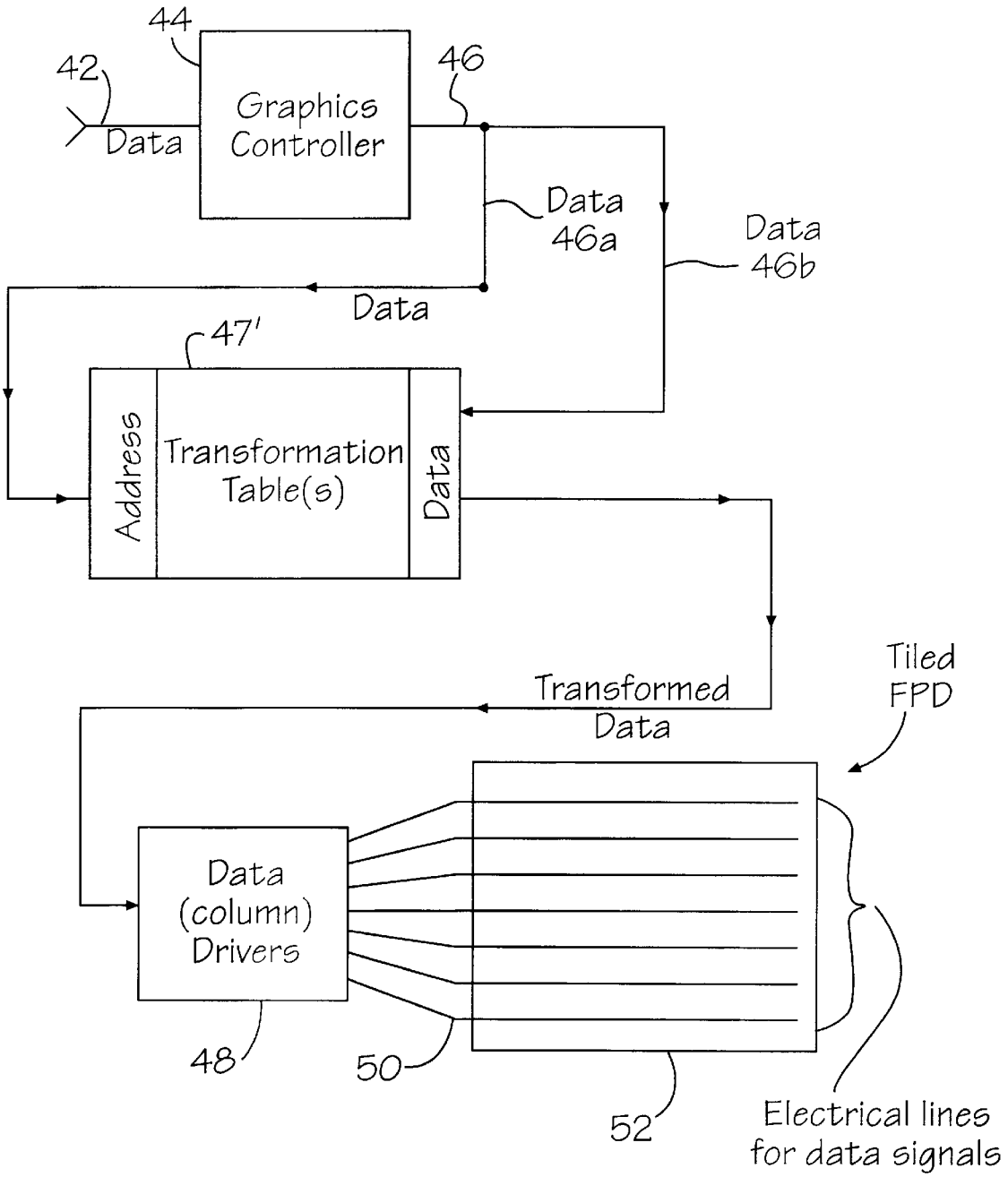
FIG. 11 is a block diagram representing the first general data path architecture for color matching by direct data transformation from a read-write table.

It should be understood that transformation table 47' may also be a read-write memory device, as shown in FIG. 11, rather than a read-only memory device referred to in FIG. 10. Synchronized data 46 from the graphics controller 44 is applied to the transformation table 47' via separate lines 46*a* and 46*b*, as shown. The write capability of table 47' is useful for manufacturing, testing and set-up, when the various values can be loaded, and the spatial luminance response of the tiled FPD 52 is measured to determine correct transformed values, or user-adjustable preferences to implement as brightness and/or contrast controls or field servicing.

Figure 12:
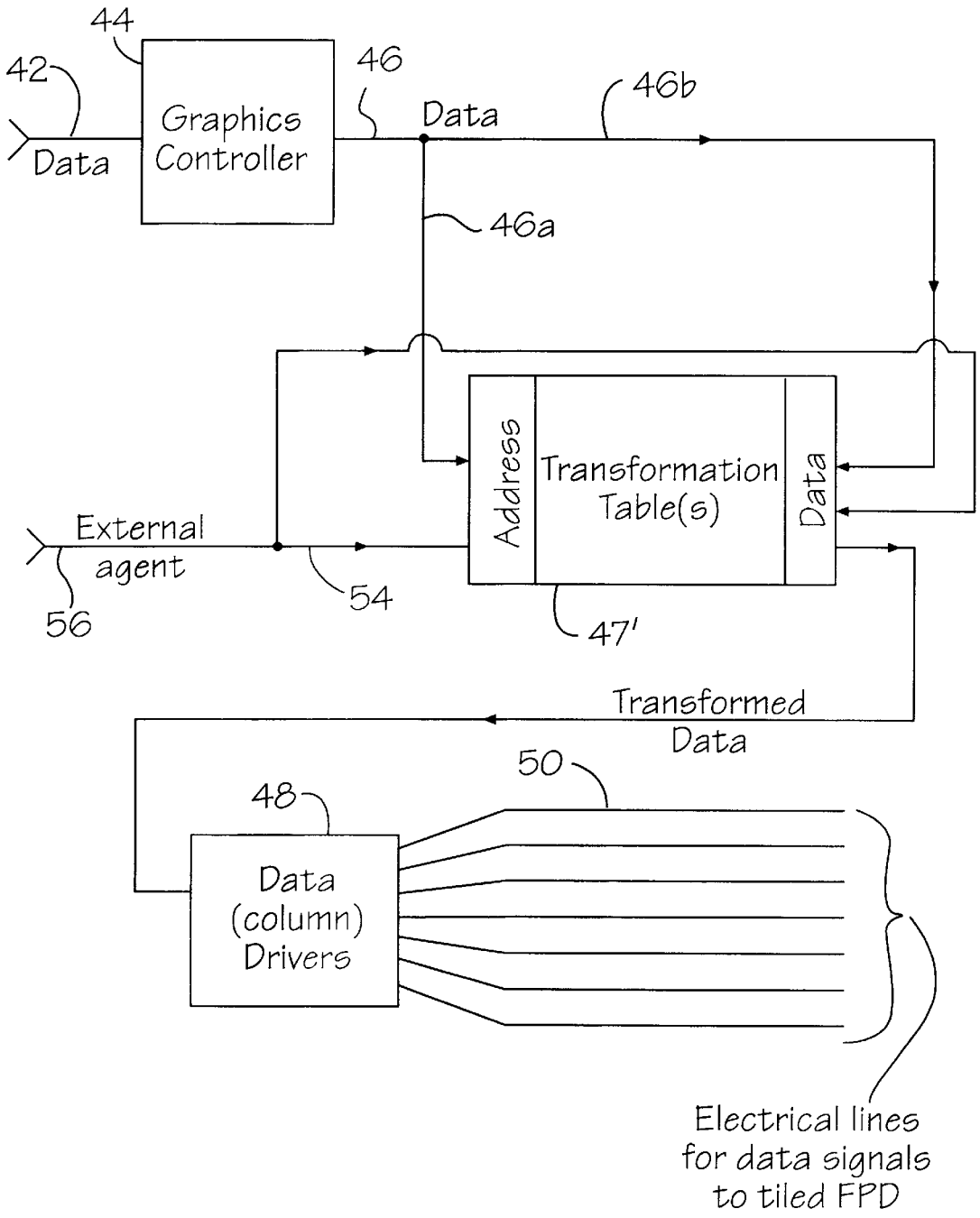
FIG. 12 is a block diagram representing the first general data path architecture for color matching by direct data transformation from a read-write table, having external address and write capabilities.

Referring now to FIG. 12, the transformation table 47' can be addressed and written from the graphics controller 44 and also, via line 54, directly from an external agent 56, such as the computer, receiver or electronics system, of which the display is a subsystem, a factory set-up or field service.

Figure 13:
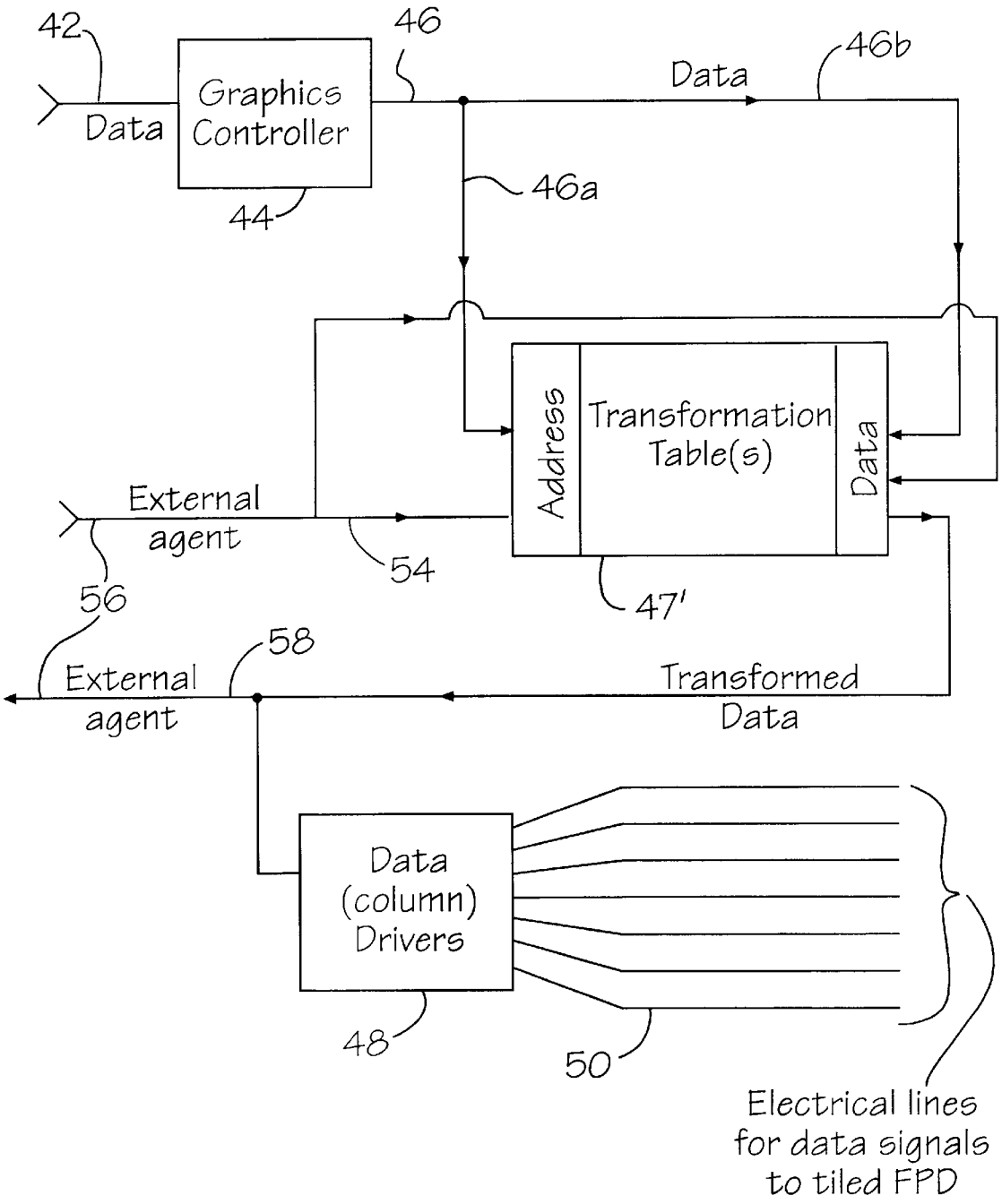
FIG. 13 is a block diagram representing the first general data path architecture for color matching by direct data transformation from a read-write table, having external address, write and read capabilities.

Moreover, the external agent 56 can also read data from the transformation table 47', via line 58 (FIG. 13), as well as address and write data to it.

Figure 14:
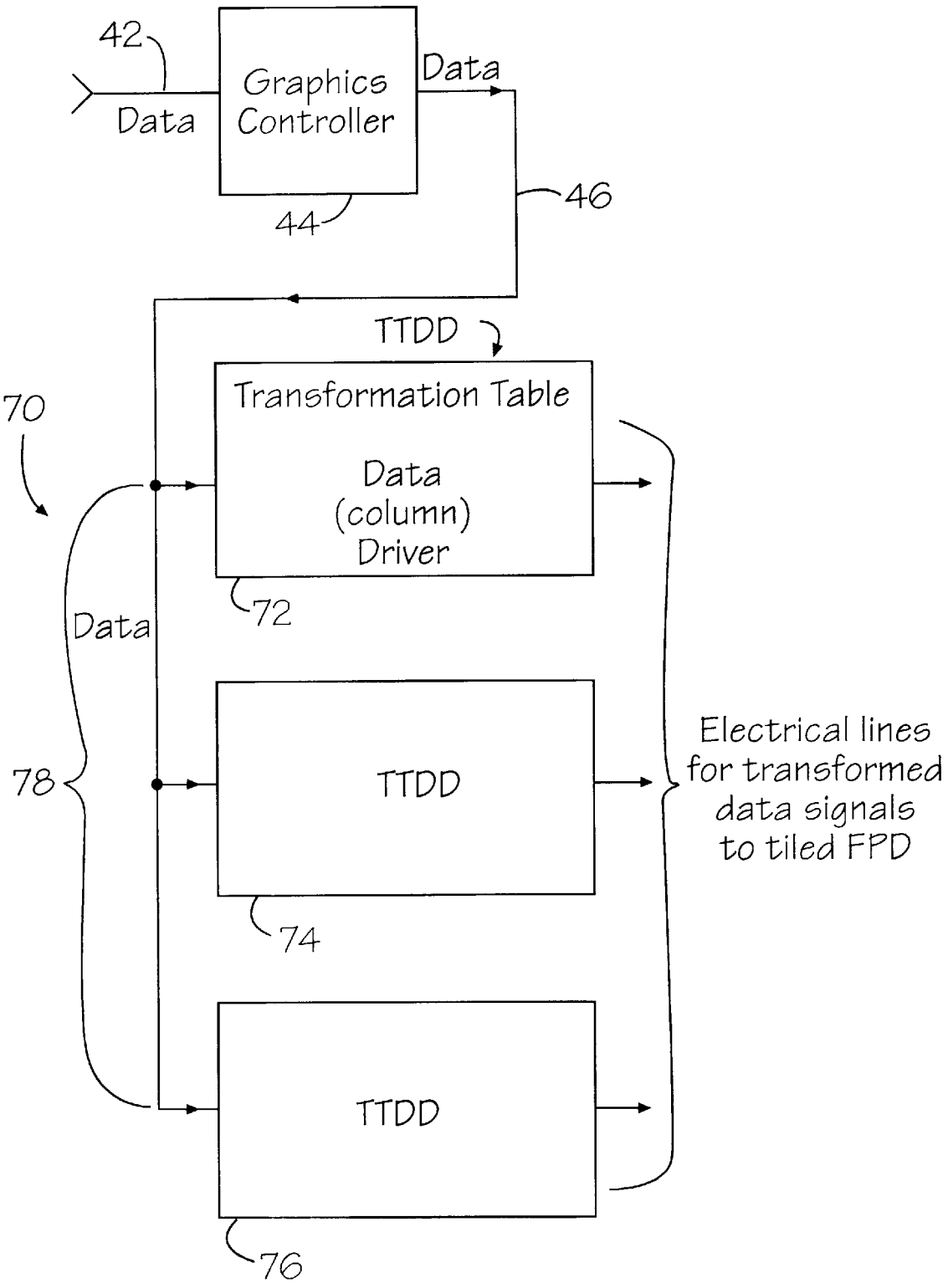
FIG. 14 is a block diagram representing an alternative general data path architecture for color matching by direct data transformation table using a new, integrated circuit, including both the transformation table and data-driver functions implemented in the same integrated circuit.

Referring now also to FIG. 14, a high-level block diagram 70 is shown, representing an alternative, general, data-path architecture for color matching a tiled FPD by direct transformation from tables. Transformation tables 72, 74, 76 . . . are directly integrated into the data (column) driver-integrated circuit devices, shown generally as reference numeral 78. Each transformation table 72, 74, 76 . . . may be a read-write form of a table, a read-write table having external address and write, and a read-write table having external address, write and read capabilities.

Figure 15:
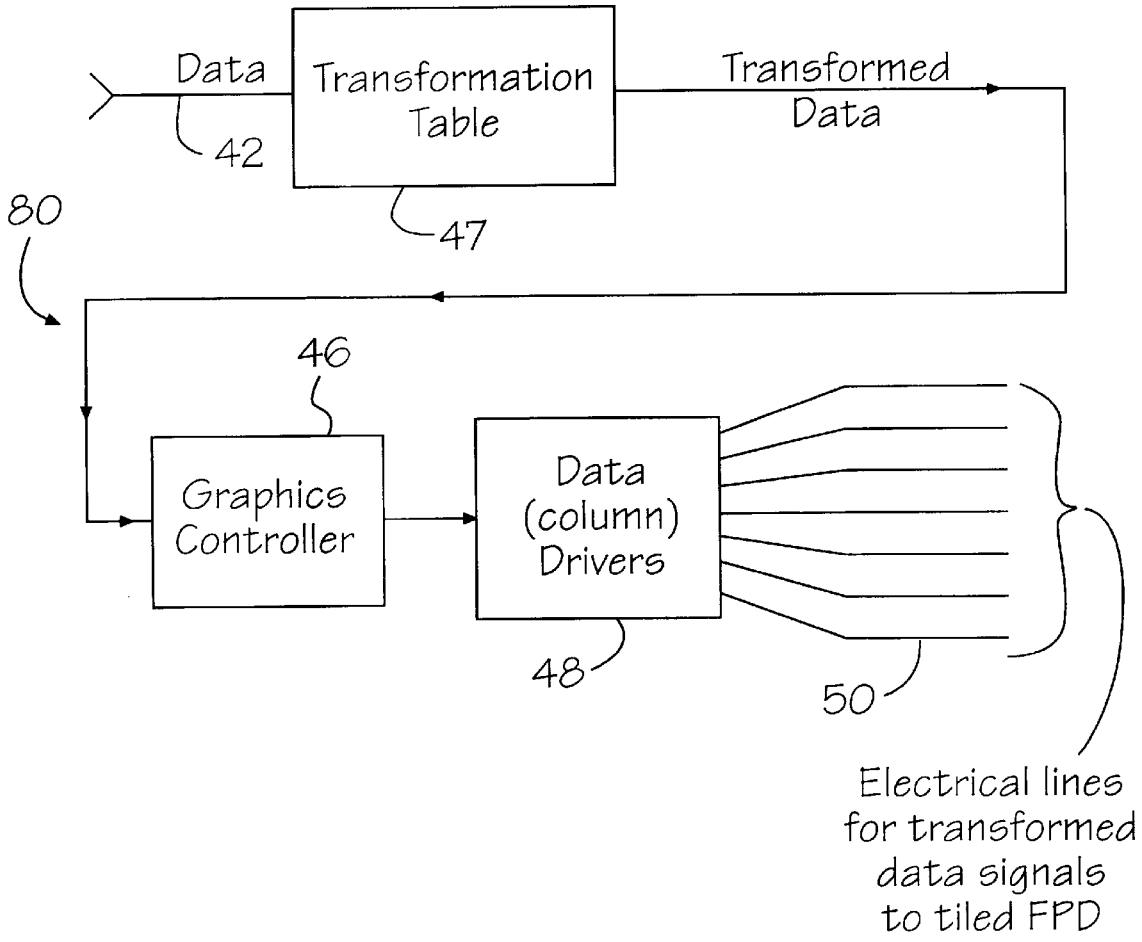
FIG. 15 is a block diagram representing the third general data path architecture for color matching using a direct data transformation table, located between the data source and the graphics controller.

Referring now to FIG. 15, another block diagram 80 is shown, representing another alternative, general, data-path architecture for color matching a tiled FPD by direct transformation from a table. The transformation table 47 is disposed upstream of the graphics controller 46 and can be any of a wide variety of storage devices, such as SRAM, DRAM, ROM, PROM, flash memory, video RAM and dual port RAM.

The previous figures and discussion have implicitly assumed that the input data is in digital, not analog form. However the methods and teachings of this invention are also directly applicable to systems with analog form data signals. This is because analog to digital converters (ADCs) and digital to analog converters (DACs) may be used to convert the analog signals to digital form wherein the aforementioned methods may then be applied, and then converted back to analog form. Such DACs and ADCs are standard electronics components.

Figure 16:
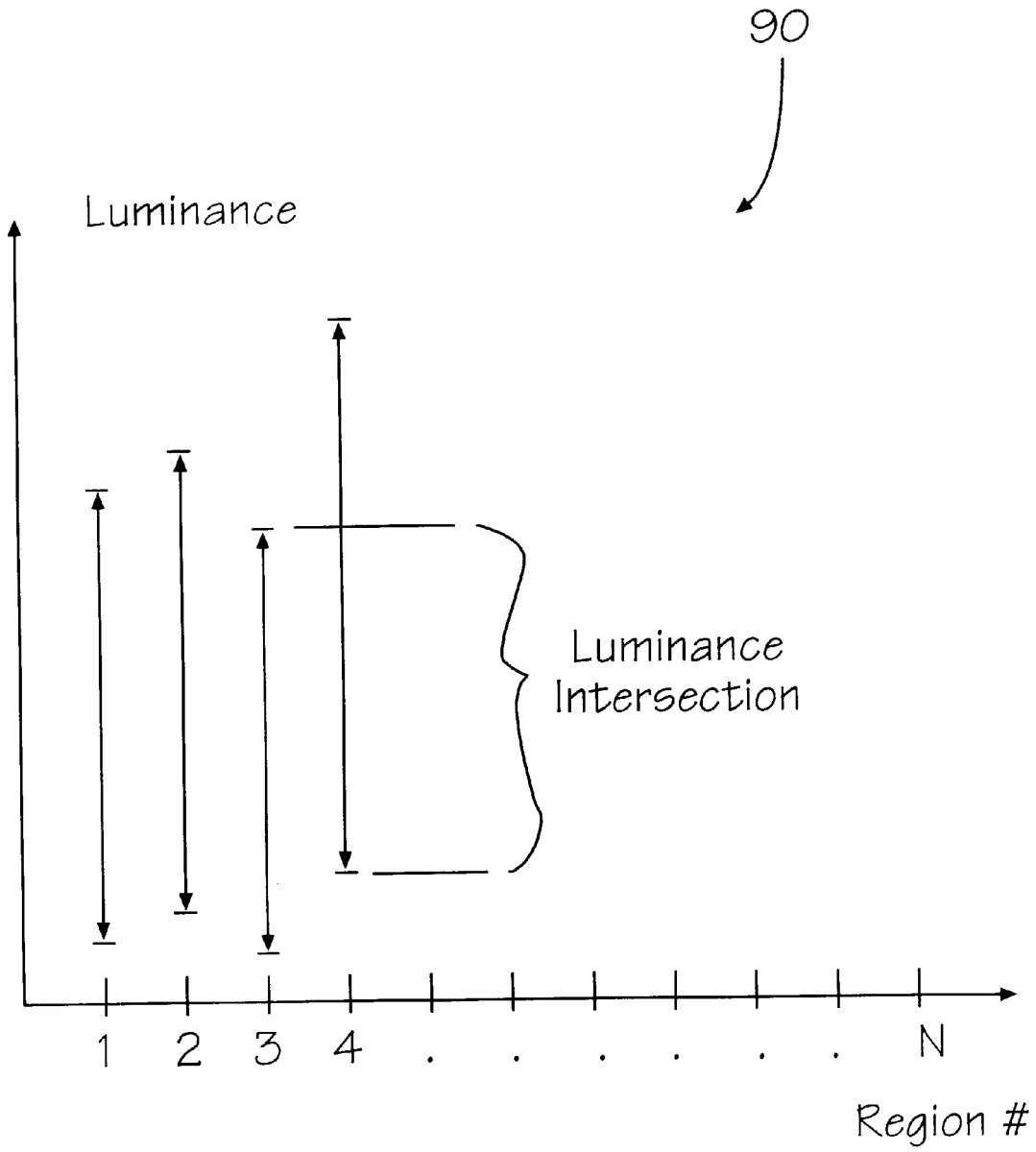
FIG. 16 is a graphical representation of the intersection of measured luminance responses from a number of regions in the display.

The above, tiled, FPD data-path architectures (FIGS. 10–15) are even more useful when used in combination with a method for determining the transformed values. Such procedures will now be described in the following steps:

1) sub-dividing the display into smaller regions of pixels (not necessarily of the same size);
2) measuring the luminance response with respect to a representative number of input-signal levels for each primary color in each region;
3) determining the intersection (i.e., the largest common response) of all of the different regions' responses for each primary color, as illustrated in the graph 90, shown in FIG. 16; and
4) creating a table of transformed values for each region and each primary color, comprising the values that give the desired number of levels at uniform intervals in the region of common response for each region and each color.

The aforementioned procedures result in a list of tabular data used to correct each color to the appropriate luminance level for each of the regions of the display, in order to achieve an image of uniform color purity.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. System architecture for matching color in a matrix-addressable, tiled, flat-panel display (FPD), said FPD having a set of electrical lines for receiving video data, said system architecture comprising:

a) graphics-controlling means for: (i) receiving electrical signals comprising data from a video, data-generating device; (ii) synchronizing, routing and controlling the timing of said data, and (iii) generating a data signal that is representative of said data;

b) data-transformation means operatively connected to said graphics-controlling means for: (i) receiving said data signal; (ii) transforming said data in accordance with a predetermined set of color-correcting transformation values; and (iii) generating a transformed-data signal that is representative of said transformed data; and c) data-driving means operatively connected to said data-transformation means for receiving said transformed-data signal therefrom, and operatively connected to said set of FPD electrical lines for applying said transformed data thereto.

2. The system architecture in accordance with claim 1, wherein said data-transformation means comprises a table of stored data, said table comprising a read-only memory device, and wherein said received video, data-generating device electrical signals comprise individual signals associated with at least one predetermined primary color, and said read-only memory device comprises separate read-only memory devices for each of said predetermined primary colors.

3. The system architecture in accordance with claim 1, wherein said data-transformation means comprises a table of stored data, said table comprising a read-only memory device, and wherein said table of stored data comprises stored color correcting transformation data corresponding to at least one region in said tiled, flat-panel display, each region having associated therewith a plurality of x-axis and y-axis coordinate indices defining said at least one region, and wherein said read-only memory device comprises separate read-only memory devices for said x-axis and said y-axis coordinate indices.

4. The system architecture in accordance with claim 3, wherein said read-only memory device further comprises means for decoding said x-axis and said y-axis coordinate indices.

5. The system architecture in accordance with claim 4, wherein said means for decoding comprises a micro-controller.

6. The system architecture in accordance with claim 5, wherein said micro-controller further comprises embedded instructions.

7. System architecture for matching color in a matrix-addressable, tiled, flat-panel display (FPD), said FPD having a set of electrical lines for receiving video data, said system architecture comprising:

a) data-transformation means for: (i) receiving electrical signals comprising data from a video, data-generating device; (ii) transforming said data in accordance with a predetermined set of color-correcting transformation values; and (iii) generating a transformed-data signal that is representative of said transformed data;

b) graphics-controlling means operatively connected to said data-transformation means for: (i) receiving said transformed data signal; (ii) synchronizing, routing and controlling the timing of said data; and (iii) generating a data signal that is representative of said data; and c) data-driving means operatively connected to said graphics-controlling means for receiving said data signal therefrom, and operatively connected to said set of FPD electrical lines for applying said data thereto.

8. A method of color-matching regions of a matrix-addressable, tiled, flat-panel display (FPD), the steps comprising:

a) receiving electrical signals comprising data from a video, data-generating device;

b) transforming said data via color-correcting data-transformation means;

c) generating a transformed-data signal that is representative of said transformed data; and d) applying said transformed-data signal to data-drivers of an FPD.

9. The method of color-matching regions of a matrix-addressable, tiled, FPD in accordance with claim 8, wherein said data-transforming means comprises memory means in which linear color-correcting transformation data is stored.

10. The method of color-matching regions of a matrix-addressable, tiled, FPD in accordance with claim 9, wherein said linear transformation data is generated in accordance with sub-steps comprising:

$b_1$) subdividing said FPD into a plurality of regions;

$b_2$) measuring luminance response in predetermined regions with respect to a predetermined number of input signal levels of at least one primary color;

$b_3$) determining the intersection of a predetermined number of said regions' response for said at least one primary color; and $b_4$) creating a table of transformed values for a predetermined number of regions and said at least one primary color, said transformed values being representative of linear transformation factors used to ensure a desired number of levels at intervals in the region of common response.

* * * * *